US009290003B2

(12) United States Patent
Marrs et al.

(10) Patent No.: US 9,290,003 B2
(45) Date of Patent: Mar. 22, 2016

(54) INKJET INK CONTAINERS HAVING OXYGEN SCAVENGING PROPERTIES

(71) Applicant: PolyOne Corporation, Avon Lake, OH (US)

(72) Inventors: Lynn I. Marrs, El Granada, CA (US); Roger W. Avakian, Solon, OH (US); John H. Hornickel, Medina, OH (US)

(73) Assignee: PolyOne Corporation, Avon Lake, OH (US)

( * ) Notice: Subject to any disclaimer, the term of this patent is extended or adjusted under 35 U.S.C. 154(b) by 0 days.

(21) Appl. No.: 14/767,688

(22) PCT Filed: Jan. 24, 2014

(86) PCT No.: PCT/US2014/012986

§ 371 (c)(1),
(2) Date: Aug. 13, 2015

(87) PCT Pub. No.: WO2014/126698

PCT Pub. Date: Aug. 21, 2014

(65) Prior Publication Data

US 2015/0352854 A1 Dec. 10, 2015

Related U.S. Application Data

(60) Provisional application No. 61/764,431, filed on Feb. 13, 2013.

(51) Int. Cl.
*B41J 2/175* (2006.01)
*B65D 81/26* (2006.01)

(52) U.S. Cl.
CPC ..... *B41J 2/17553* (2013.01); *B65D 81/266* (2013.01)

(58) Field of Classification Search
CPC ..... B41M 5/502; B41M 5/506; B41M 5/50; B41M 5/52; B41M 5/10; B41M 7/00
See application file for complete search history.

(56) References Cited

U.S. PATENT DOCUMENTS 5,681,380 A * 10/1997 Nohr ..... B43M 11/08 106/31.36
5,759,653 A 6/1998 Collette et al.
2010/0215921 A1 8/2010 Kagose
2012/0241406 A1 9/2012 Beuerle et al.

FOREIGN PATENT DOCUMENTS

EP 0 583 727 A1 2/1994
WO 00/71334 A1 11/2000

OTHER PUBLICATIONS

International Preliminary Report on Patentability for PCT/US2014/012986.

* cited by examiner

*Primary Examiner* — Juanita D Jackson
(74) *Attorney, Agent, or Firm* — John H. Hornickel

(57) ABSTRACT

An inkjet ink container is disclosed comprising a polymer compound comprising an oxygen scavenging composition. The oxygen scavenging composition is selected from the group consisting of copolymers of polycondensate segments and oxygen scavenging moiety segments; oxygen scavenging unsaturated polymers; oxygen scavenging dendrimers; molecular hydrogen generators; and combinations thereof.

8 Claims, 2 Drawing Sheets

INKJET INK CONTAINERS HAVING OXYGEN SCAVENGING PROPERTIES

CLAIM OF PRIORITY

This application claims priority from U.S. Provisional Patent Application Ser. No. 61/764,431 filed on Feb. 13, 2013, which is incorporated by reference.

FIELD OF THE INVENTION

The invention concerns inkjet cartridges and reservoirs made from polymer materials including oxygen scavenging functional additives.

BACKGROUND OF THE INVENTION

Spoilage of food has plagued humanity for millennia. Containers for food have evolved from stone to ceramic to metallic to glass to plastic, particularly for single serving consumable foods and beverages.

Shelf life of foods and beverages is affected by oxidation from oxygen molecules within the volume of the container not occupied by the food or beverage ("headspace oxygen"), within the bulk of the container walls ("inherent oxygen"), and permeating through the container walls or closure ("permeated oxygen"). Also the food or beverage itself contains oxygen which equilibrates in the headspace.

Packaging of food or beverages has utilized oxygen scavenging compositions to help preserve the freshness from oxidation by headspace oxygen, inherent oxygen, and permeated oxygen. Any food or beverage, medicament or cosmetic, or any other material highly reactive with oxygen molecules can benefit from this invention. Shelf life of food and other perishable materials can be extended because of the presence of the oxygen scavenging composition, preferably activated by a catalyst at an appropriate time.

The ColorMatrix Corporation is a leader in the supply of oxygen scavenging compositions to the food and beverage industry worldwide.

SUMMARY OF THE INVENTION

Inkjet printing ink is another material which can be reactive with oxygen molecules.

What the art needs is an inkjet cartridge, reservoir, or other container to have the benefit of oxygen scavenging.

The present invention solves the problem in the art by utilizing polymer compounds containing oxygen scavenging compositions, which compounds are shaped into containers of any size already used or useful in the delivery of inkjet ink.

For purposes of this invention, "container" means a vessel of any size or shape in which inkjet ink is stored before association with an inkjet printer, such as a storage container of ink in bulk, or after association with an inkjet printer, such as an inkjet cartridge in its holder in a desktop printer or a larger reservoir associated with a commercial scale large format inkjet printer.

One aspect of the present invention is an inkjet ink container comprising a polymer compound comprising an oxygen scavenging composition.

An advantage of oxygen scavenging inkjet ink containers related to cost reduction is that the amount of packaging protection for the cartridge, which typically uses an expensive foil lined or multi-layer film to protect the cartridge from $O_2$ exposure, can be eliminated or reduced in complexity and cost. For example, oxygen barrier tie layers might be eliminated or reduced in number in foil or multi-layer film packaging for inkjet ink cartridges. An additional benefit is that such packages will be easier to open.

Other advantages of the invention are mentioned in connection with various embodiments.

EMBODIMENTS OF THE INVENTION

Inkjet Containers

Any container as defined above is a candidate for use in the present invention. What qualifies a container to be a candidate is that it is made of a polymer compound, it is intended to contain inkjet ink for any duration, and it benefits from the addition of an oxygen scavenging composition.

Non-limiting examples of inkjet containers include inkjet cartridges such as those disclosed in U.S. Pat. No. 6,851,800 (Seu); U.S. Pat. No. 6,030,075 (Swanson et al.); U.S. Pat. No. 5,745,137 (Schefflin et al.); and U.S. Pat. No. 5,594,483 (Kaplinsky et al.); all of which are incorporated by reference herein as if fully rewritten in their entirety.

Using U.S. Pat No. 6,851,800 as one embodiment of an inkjet cartridge, Seu discloses a single-piece print cartridge body having a plurality of outlet ports disposed along a single axis that is substantially perpendicular to a direction of motion of the print cartridge body during printing. First and second compartments are respectively communicatively coupled to first and second cavities. The first and second cavities are substantially parallel to the single axis and are located on opposite sides of the single axis. A first channel interconnects the first cavity and a first one of the plurality of outlet ports. A second channel interconnects the second cavity and a second one of the plurality of outlet ports. The first and second channels are substantially perpendicular to the single axis. In another embodiment, a third compartment is connected to a third one of the plurality of outlet ports by a third channel.

Non-limiting examples of inkjet containers also include inkjet reservoirs such as those disclosed in U.S. Pat. No. 5,818,484 (Lee et al.); U.S. Pat. No. 5,949,460 (Ahn); U.S. Pat. No. 6,239,822 (Zapata et al.); and U.S. Pat. No. 5,745,137 (Schefflin et al.); all of which are incorporated by reference herein as if fully rewritten in their entirety.

Schefflin et al. is incorporated by reference for both an example of inkjet cartridge structure and inkjet reservoir structure because Schefflin et al. disclose both.

Using U.S. Pat. No. 6,239,822 (Zapata et al.) as one embodiment of an inkjet reservoir, four off-carriage ink reservoirs are identified in the specification and the drawings. The off-carriage reservoirs are structured to connect with the corresponding print cartridges via shut-off valves.

Persons having ordinary skill in the art of constructing inkjet containers, without undue experimentation, can recognize the use of a polymer compound which contains an oxygen scavenging composition.

Figure 1:
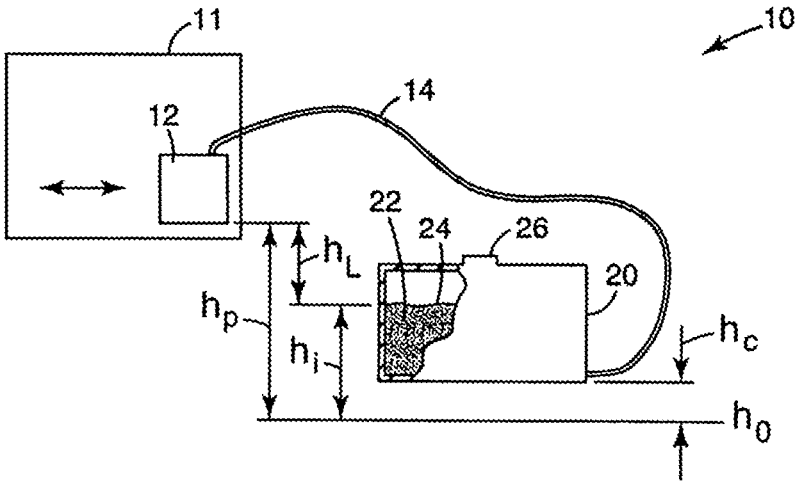
FIG. 1 is a schematic diagram of one printing system including a printing fluid supply system according to U.S. Pat. No. 5,818,484 (Lee et al.)

Referring now to FIG. 1, an illustrative embodiment of one schematic inkjet supply system 10 according to U.S. Pat. No.

5,818,484 (Lee et al.) is depicted including an inkjet printer or plotter 11 and corresponding print head 12, fluid line 14 and ink supply container 20. Also depicted in FIG. 1 is a fixed datum plane, $h_0$, which serves as a reference point for describing operation of the system 10.

Container 20 holds a supply of ink 22 having a free surface 24 located a distance $h_i$, above the datum $h_0$. The bottom of the container 20 is located a distance $h_c$ above the datum $h_0$. The container 20 is preferably open to ambient pressure through an opening such as 26 depicted in FIG. 1. Opening 26 also preferably allows for refilling of the container 20 as ink 22 is consumed during printing.

Fluid line 14 is provided to supply ink 22 from container 20 to the print head 12. Typically, it is preferred that fluid line 14 comprise a relatively small diameter tubing to reduce the amount of ink in the fluid line 14. In one illustrative embodiment, the fluid line 14 has an inside diameter of about 3.175 mm Those skilled in the art will, however, be able to select tubing with the appropriate inside diameter for their printing systems using known methods.

As shown in FIG. 1, it is preferred to draw ink 22 out of container 20 at a low point to allow for proper operation of the system down to the lowest levels of ink 22 in the container 20. Higher placement of the outlet is possible, but may require more frequent refilling of container 20. Furthermore, although the outlet is shown as located on the side of the container 20, it will be understood that the outlet could be provided as a stand pipe with its opening located near the bottom of the container 20.

The print head 12 is located a fixed distance of $h_p$ above the datum $h_0$ and is typically mounted in a printer or plotter for movement in a horizontal direction across a substrate such as paper or film. As a result, although the print head 12 moves to accomplish a printing operation, its distance $h_p$ above the datum $h_0$ remains fixed. The print head 12 is located a distance of $h_L$ above the free surface 24 of the ink 22.

One important feature of the Lee et al. invention is that it provides the ability to maintain the distance between the print head 12 and free surface 24 of the ink 22 in container 20, i.e., $h_L$, substantially constant by supporting the container 20 in a manner such that as ink 22 is removed from container 20, the container 20 itself is moved with respect to both the print head 12 and the datum $h_0$. As a result, the static pressure head between the ink 22 and the print head 12 (determined by the distance $h_L$) remains substantially constant throughout the printing process, both when ink 22 is being consumed and when ink 22 is being added to the container 20 (or if a fill container 20 replaces a nearly empty container).

Figure 2:
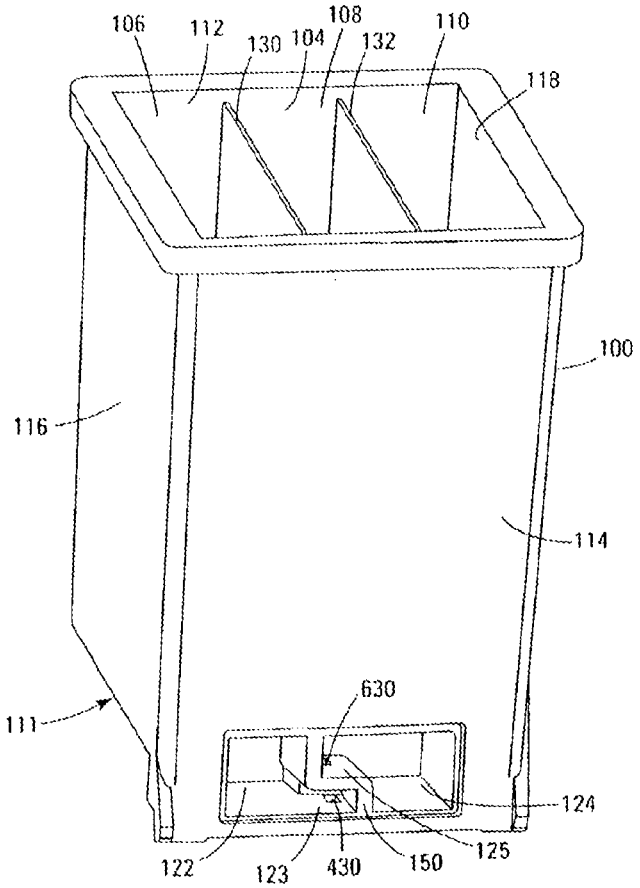
FIG. 2 is a perspective view illustrating a print cartridge body according to an embodiment of U.S. Pat. No. 6,851,800 (Seu).

FIG. 2 is a perspective view illustrating a print cartridge body 100 according to an embodiment of U.S. Pat. No. 6,851,800 (Seu). An interior 104 of print cartridge body 100 is divided into compartments (or ink reservoirs) 106, 108, and 110, each for containing a different colored ink. In one embodiment, compartments 106, 108, and 110 are located side-by-side and are substantially parallel to each other, as shown in FIG. 1.

Figure 3:
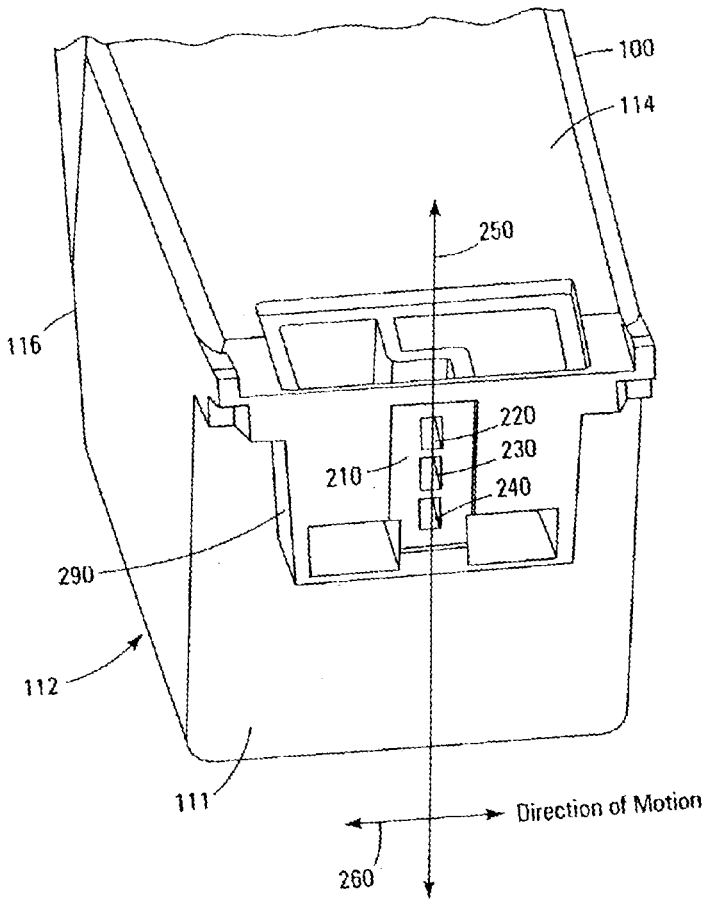
FIG. 3 is a bottom perspective view of the print cartridge body of FIG. 2.

As illustrated in FIG. 3, a bottom perspective view of print cartridge body 100, print cartridge body 100 has a print head die mounting region 210 surrounding outlet ports 220, 230, and 240 of print cartridge body 100. In one embodiment, print head die mounting region 210 and outlet ports 220, 230, and 240 are located on a wall 111 of print cartridge body 100. Outlet ports 220, 230, and 240 are aligned on a single axis 250 that is substantially perpendicular to a direction of motion of cartridge print body 100 during printing, as indicated by arrow 260.

More specifically, in one embodiment, print cartridge body 100 includes opposing walls 112 and 114. Opposing walls 112 and 114 are connected between opposing walls 116 and 118 and are substantially perpendicular to opposing walls 116 and 118. Opposing walls 112 and 1114 and opposing walls 116 and 118 define interior 104 of print cartridge body 100. In one embodiment, opposing walls 112 and 114 and opposing walls 116 and 118 are substantially perpendicular to wall 111. Partitions 130 and 132 are disposed within interior 104 and define compartments 106, 108, and 110. In one embodiment, partitions 130 and 132 are substantially parallel to each other and are substantially parallel to walls 116 and 118. Compartment 106 is located between wall 116 and partition 130, compartment 108 between partitions 130 and 132, and compartment 110 between partition 132 and wall 118.

Further, as shown in FIG. 2 for one embodiment, a stepped divider 150 separates channels 123 and 125 and enables channels 123 and 125 to overlap.

A channel 123 interconnects cavity 122 and a channel 430. Channel 430 passes through print cartridge body 100 to connect channel 123 to an outlet port 220.

A channel 125 interconnects cavity 124 and a channel 630, as shown in FIG. 2. Channel 630 passes through print cartridge body 100 to connect channel 125 to an outlet port 220.

Polymer Resin for Inkjet Container

Any thermoplastic resin can be a candidate for forming into a plastic article, such as inkjet container as defined above.

The thermoplastic resin is a matrix containing other ingredients, such as the oxygen scavenging composition, and can be formed by molding, extruding, calendering, three dimensional printing, thermoforming, etc. into the final shape of the inkjet container. Other materials identified in the patents reference above can be added to provide the completed assembly of the inkjet container so desired. Indeed, an advantage of the invention is that the structure and function of the inkjet container is unchanged, except for the addition of the oxygen scavenging composition in the thermoplastic resin to provide protection against oxidation of the ink.

Non-limiting examples of thermoplastic resins useful in this invention are polyesters (including polylactides and polyhydroxyalkanoates), polyamides, polyolefins, polycarbonates, polystyrenes, polyacrylates, thermoplastic elastomers (including thermoplastic vulcanizates) of all types, and the like.

Because the shelf-life of inkjet ink needs protection from the oxidizing effect of reactions with oxygen molecules within or penetrating the inkjet containers, the selection of the thermoplastic resin to be used as the matrix in the present invention is predicated on cost, performance, appearance, and other considerations already inherent in the inkjet printing industry.

Of the polymeric candidates, polyesters and polyethylene are preferred. Of them, polyesters are particularly preferred. While many inkjet containers are made of the more expensive polybutylene terephthalate (PBT), the addition of the oxygen scavenging composition can permit the use of the less expensive polyethylene terephthalate (PET), virginal or recycled, as the thermoplastic resin for the matrix forming the inkjet container. Additionally, thermoplastic elastomers are preferred for use as closures or closure liners or gaskets or seals or other constructions which are a part of a conventional inkjet container.

Oxygen Scavenging Composition

Any oxygen scavenging composition is a candidate for use in this invention. The mechanism of scavenging is based on the composition having chemical properties which are ready for reaction with oxygen molecules.

The amount of oxygen scavenging composition to be present in the polymer resin for the inkjet container is a function of the size of the container, the amount of ink, the amount of oxygen of any of three types identified above, and the duration of storage desired. Without undue experimentation, a person having ordinary skill in the art can make a determination of the sufficiency of any particular amount of oxygen scavenging composition depending on the type of oxygen scavenging composition to be employed. Without limitation, four different types are identified here as useful.

Copolymer of Polycondensate Segments and Oxygen Scavenging Moiety Segments

One type of oxygen scavenging composition is typified by U.S. Pat. No. 7,214,415 (Tibbett et al.), incorporated by reference herein as if fully rewritten in its entirety. The oxygen scavenging composition is comprised of a modified copolymer comprised of predominantly polycondensate segments containing a lesser weight percentage of oxygen scavenging moiety (OSM) segments. The OSM segments need only be present in an amount necessary to provide the degree of oxygen scavenging capacity needed for the particular application.

The OSM segments of the oxygen scavenging copolymers are at least singly functionally terminated with a group capable of entering into polycondensation polymerization and/or capable of reaction with previously formed polyester moieties to form new covalent bonds. Alternately, these OSM segments can react with the polymer end groups to provide a copolymer structure. A functionally terminated OSM may be represented by Formula 1.

X–(OSM)–Y Formula 1

Double functionality is shown in Formula 1 as one possibility but the OSM may be singly functionally terminated or functionalized to a degree greater than two. Those persons having ordinary skill in the art will recognize that the commercial availability of functionally terminated OSM species will obviate the need to add such functionalization. An essential feature of the OSM of Formula 1 is that it is readily oxidizable at ambient temperature, and this auto-oxidation does not result in the generation of significant volatile or extractable by-products.

Preferred OSM's include polyolefin oligomers of molecular weight 100 to 10,000, polypropylene oxide oligomers, or methyl pendant aromatic compounds as defined in U.S. Pat. No. 6,346,308 (Cahill et al.), incorporated by reference herein as if fully written in its entirety. The polybutadiene moiety, when incorporated as segments in a modified copolymer, serves as a suitable OSM. However, especially preferred is the unhydrogenated polybutadiene oligomer of MW 1000-3,000. In Formula 1, X and Y are typically the same and may be any species capable of entering into polycondensation and/or transesterification. A non-limiting list of possible species represented by X or Y includes OH, COOH, $NH_2$, epoxides, and substituted derivatives thereof capable of entering into step-growth, condensation and/or transesterification reactions.

Oxygen Scavenging Unsaturated Polymer

A second type of oxygen scavenging composition is typified by a reducing agent for oxygen molecules comprising a polymer formed from a base component, an unsaturated polymeric reducing component, and, optionally, a linking component, such as disclosed in U.S. Patent Application Publication 20120100263 (Hu et al.), incorporated by reference herein as if fully written in its entirety. More particularly, the unsaturated polymer is the polymerization product of macrocyclic poly(alkylene dicarboxylate) oligomer, unsaturated functional polymer, and, optionally epoxy-functional styrene-acrylate oligomer. Non-limiting examples of unsaturated functional polymeric reducing components include hydroxyl- or glycidyl-functional polyalkenes or polyalkynes, such as a hydroxyl-terminated polybutadiene or an epoxy functionalized hydroxyl-terminated polybutadiene. Of these examples, a commercially available hydroxyl-terminated polybutadiene is preferred because it is a colorless liquid amenable to use in reactive extrusion polymerization and has a number average molecular weight of about 2800 with approximately 20% of the backbone being vinyl double bonds (CAS #69102-90-5). Hu et al. discloses a terpolymer, but the present invention could also benefit from a copolymer of macrocyclic poly(alkylene dicarboxylate) oligomer and unsaturated functional polymer.

Terpolymers synthesized according to Hu et al. or copolymers identified in the preceding paragraph are unsaturated macromolecules capable of reacting with oxygen molecules and scavenge for those oxygen molecules at the surface of the article in which such macromolecules reside and within the bulk of the wall itself. A benefit of use of macromolecular polymers is that they are not themselves volatile or mobile within the volume contained by thermoplastic article holding inkjet ink. Macromolecules do not migrate from the thermoplastic compound.

The combination of the base component, the unsaturated functional polymeric reducing component, and, optionally, the linking component to form the polymer makes it suitable for use in inkjet containers because the polymer is compatible with the thermoplastic matrix of the plastic article in order to provide good dispersion therein. Alternatively, the polymer has good compatibility at a molecular level with the thermoplastic matrix to optimize clarity and translucency. Most preferably, the polymer is miscible with the thermoplastic matrix.

The oxygen scavenging properties of the unsaturated polymer arise from the presence of carbon-carbon unsaturated bonds remaining as an unreacted part of the unsaturated functional polymeric reducing component after polymerization of the polymer. These carbon-carbon unsaturated bonds are susceptible to reaction with oxygen molecules. Indeed, whereas other uses of such macromolecules as polymers might be seen as decaying in the presence of oxygen, their use as an oxygen scavenging additive to the thermoplastic matrix is beneficial in the present invention.

The polymer benefits from catalysis of the two or three components during polymerization. A commercially available catalyst can be used. Presently preferred is an organic titanate such as titanium tetrakis(2-ethylhexanolate) (CAS #1070-10-6).

The polymer can accommodate a wide variety of amounts of the two or three components, but it has been found that a plurality, and preferably a majority of unsaturated functional polymeric component is preferred because the oxygen scavenging capacity is directly related to the number of unreacted carbon-carbon unsaturated bonds available for reducing oxygen and eliminating it from the interior volume of the plastic packaging article.

The polymer is macromolecular and not susceptible to migration or "blooming" from the bulk of the plastic article to a surface of the plastic article but have unsaturated carbon-carbon moieties which are vulnerable to oxidation by free oxygen molecules which come into contact with them, whether within the bulk of the plastic packaging article wall or on the surface of that wall. In effect, this vulnerability becomes the reducing agent of the macromolecular polymer and each oxygen molecule-unsaturated carbon bond reaction is a scavenging event for mobile oxygen molecules within an inkjet container as defined above made using polymers of the present invention.

The polymer can be mixed into the thermoplastic matrix alone, but the compound preferably benefits from the use of an oxidation catalyst, one that assists the reduction reaction with oxygen.

Indeed, when a catalyst is to be used, it is possible for the catalyst to be pre-mixed into the thermoplastic matrix before compounding with the polymer or pre-mixed into a masterbatch carrier before molding with the polymer and the thermoplastic matrix.

Catalysts can help activate the unsaturated reducing agent component of the polymer. Catalysts are not required, but they are preferred. If present, they can be photo-activated catalysts, moisture-activated catalysts, heat-activated catalysts, etc., all well known to a person having ordinary skill in the art.

Unsaturated polymers of this second type can proceed in the scavenging for oxygen without the need for catalysis. For example, inkjet containers which are formed at or near the same time as the filling of that container with inkjet ink can benefit from such oxygen scavenging agents that do not need activation to begin reducing oxygen molecules.

However, for one particular industry serving as an example for persons skilled in the art of making inkjet containers, it is quite important for the unsaturated polymer, functioning as the reducing agent for oxygen molecules, to remain dormant until container formation. Beverage bottles and other liquid containers are often made in two steps, one to form a so-called "pre-form" which has the final dimensions of the opening but is collapsed with respect to the final volume; and the second to mold the pre-form into a container, vessel, or bottle of final dimensions. For example, water, soft drink, and beer bottles start as pre-forms with the proper dimensions of the screw cap mouth and a highly collapsed remainder resembling a deflated bottle or a truncated test tube. At the bottling factory, the pre-forms are expanded by blow molding to form liter or half liter bottles just prior to beverage filling.

The relative dormancy of the oxygen scavenging function of the polymer is important for the beverage industry because one does not want to waste the oxygen scavenging properties on a pre-form exposed to the environment during storage, prior to blow molding and filling. Therefore, for this industry in particular, and any other which relies on pre-formed partially completed containers, the onset of oxygen scavenging needs to be triggered by an event after the formation of the pre-form.

Non-limiting examples of catalysts are transition metals (heat-activated) and benzophenones (photo-activated). The concentration of catalyst relative to polymer can be as little as 10 parts per million of polymer to contribute to oxygen scavenging.

Of the catalysts, transition metal salts are most preferred because they are thermally activated. Such salts include those of cobalt, cerium, manganese, etc. These types of catalysts are suitable for activation of the polymer to function as a macromolecular oxygen reducing agent at the time of formation of the pre-form into a blow-molded bottle, which happens at elevated heat to melt the pre-form for ultimate shaping.

A non-limiting example of a commercially available catalyst is cobalt stearate (CAS #13586-84-0) to serve as a catalyst for the oxidation of the oxidizable organic compounds.

Oxygen Scavenging Dendrimers

A third type of oxygen scavenging composition is typified by oxygen scavenging dendrimers such as those disclosed in U.S. Patent Application Publication No. 20120070545 (Hu et al.), incorporated by reference herein as if fully rewritten in its entirety. More particularly, the oxygen scavenging composition is an amphiphilic dendritic polymer ("dendrimer") functioning as a reducing agent for oxygen molecules.

The usefulness of this dendrimer is its locations of unsaturation on the hydrophobic chains.

As further reported by its manufacturer, Perstorp, Boltorn™ W3000 dendritic polymer is a non-ionic, self-emulsifying amphiphilic dendritic polymer, consisting of a dendritic globular structure from which chain ends are terminated by a combination of hydrophobic chains (long unsaturated fatty acid allowing air drying oxidation process) and hydrophilic chains (methyl polyethylene glycol chains).

The amphiphilic nature of this dendritic polymer confers some dispersing and stabilizing properties. This behavior is used to disperse conventional alkyd resins (initially prepared for solvent borne systems) in water. A core/shell particle type of emulsion is obtained, the core being the alkyd resin that controls the coating properties and the shell being the amphiphilic dendritic polymer. BOLTORN™ W3000 polymer is made from a pentaerythritol derivative which still has 4 alcohols able to build layers with dimethylproprionic acid (DMPA) and get the hyperbranched polyester morphology (i.e., its dendrimer structure) which then is functionalized, followed by being capped with methyl polyethylene glycol (MPEG) and some hydrophobic sunflower fatty acid.

The dendrimer is macromolecular and not susceptible to migration or "blooming," especially because of its amphiphilic nature.

The dendrimer is particularly advantageous in use as a reducing agent for oxygen molecules is because its dendritic structure makes many unsaturated carbon-carbon bonds available for oxidation, per unit volume of dendrimer. These unsaturated carbon-carbon bonds are vulnerable to oxidation by free oxygen molecules which come into contact with them, whether within the bulk of the plastic packaging article wall or on the surface of that wall. In effect, this vulnerability becomes the reducing agent of the macromolecular dendrimer and each oxygen molecule--carbon-carbon double bond reaction is a scavenging event for mobile oxygen molecules within a food or beverage container or package made using the dendrimers.

As with the second type of oxygen scavenging composition, an optional catalyst can be used to help activate the hydrophobic chains of the dendrimer. The catalysts mentioned for the oxygen scavenging unsaturated polymer are also useful for the oxygen scavenging dendrimer.

Molecular Hydrogen Generator

A fourth type of oxygen scavenging composition is typified by a hydrogen generating means disclosed in U.S. Patent Application Publication 20100028499 (Rule et al.), incorporated by reference herein as if fully rewritten in its entirety.

Long-term protection from oxygen ingress can be provided to permeable inkjet containers by inclusion of a hydrogen generating means which may comprise one or more components that slowly release molecular hydrogen inside the container over an extended period of time. In the presence of a suitable catalyst, the molecular hydrogen will react with any oxygen present in the interior of the container or in the container wall. Preferably, the rate of hydrogen release is tailored to match the rate of oxygen ingress into the container. In addition, it is preferable for there to be an initial relatively rapid release of hydrogen, followed by a slow continual release over a period of months or even years. Furthermore, it is preferred that substantial release of hydrogen reliably begins only when the inkjet container is filled. Finally, it is preferable that the substance releasing hydrogen does not adulterate the contents of the container.

The container may include a sidewall constructed from a composition that includes a polymer resin first component described above and a second component comprising a catalyst capable of catalyzing a reaction between molecular hydrogen and molecular oxygen. The container may also include a third component capable of releasing molecular hydrogen for an extended period of time. The third component is preferably located within the container or near an interior surface of the container. The component capable of releasing molecular hydrogen is preferably located in or on a closure of the container. Suitably, the component capable of releasing molecular hydrogen comprises an active substance that releases molecular hydrogen by reaction with moisture.

The polymeric matrix may include at least 1 wt % of active substance to generate hydrogen, preferably at least 2 wt %. The polymeric matrix may include less than 16 wt % of active substance. Suitably, the polymeric matrix includes 1-16 wt %, preferably 4-8 wt % of active substance. The balance of material in the polymeric matrix may predominantly comprise a said polymeric material.

The active substance may comprise a metal and/or a hydride. A said metal may be selected from sodium, lithium, potassium, magnesium, zinc or aluminum. A hydride may be inorganic, for example it may comprise a metal hydride or borohydride; or it may be organic.

Active substances suitable for the release of molecular hydrogen as a result of contact with water include but are not limited to: sodium metal, lithium metal, potassium metal, calcium metal, sodium hydride, lithium hydride, potassium hydride, calcium hydride, magnesium hydride, sodium borohydride, and lithium borohydride. While in a free state, all of these substances react very rapidly with water; however, once embedded into a polymeric matrix, the rate of reaction proceeds with a half-life measured in weeks to months. For example, sodium borohydride reacts with pH 7 water with a half-life of less than about 5 seconds at 22 deg C. However, at 22° C., 4 wt % dispersion of sodium borohydride dispersed in low density polyethylene (LDPE) exhibits a half-time for hydrogen generation in excess of 180 days. Even more dramatically, when dispersed into LDPE, sodium hydride releases hydrogen over a period of months, whereas the dry powder ignites on exposure to water, and even a 60% oil dispersion of sodium hydride will release hydrogen violently.

Other active substances may include organic hydrides such as tetramethyl disiloxane and trimethyl tin hydride, as well as metals such as magnesium, zinc, or aluminum. Where the rate of reaction between the active substance and water is too slow, the addition of hydrolysis catalysts and/or agents are explicitly contemplated. For example, the rate of hydrolysis of silicon hydrides may be enhanced by the use of hydroxide or fluoride ions, transition metal salts, or noble metal catalysts.

In order to facilitate the reaction between molecular hydrogen with molecular oxygen, a catalyst is desired. A large number of catalysts are known to catalyze the reaction of hydrogen with oxygen, including many transition metals, metal borides (such as nickel boride), metal carbides (such as titanium carbide), metal nitrides (such as titanium nitride), and transition metal salts and complexes. Of these, Group VIII metals are particularly efficacious. Of the Group VIII metals, palladium and platinum are especially preferred because of their low toxicity and extreme efficiency in catalyzing the conversion of hydrogen and oxygen to water with little or no byproduct formation. The catalyst is preferably a redox catalyst.

Optional Additives

The compound of the present invention can include conventional plastics additives in an amount that is sufficient to obtain a desired processing or performance property for the compound. The amount should not be wasteful of the additive nor detrimental to the processing or performance of the compound. Those skilled in the art of thermoplastics compounding, without undue experimentation but with reference to such treatises as Plastics Additives Database (2004) from Plastics Design Library (elsevier.com), can select from many different types of additives for inclusion into the compounds of the present invention.

Non-limiting examples of optional additives include adhesion promoters; biocides (antibacterials, fungicides, and mildewcides), anti-fogging agents; anti-static agents; bonding, blowing and foaming agents; compatibilizers; dispersants; fillers and extenders; fire and flame retardants and smoke suppresants; impact modifiers; initiators; lubricants; micas; nucleants; pigments, colorants and dyes; plasticizers; processing aids; release agents; silanes, titanates and zirconates; slip and anti-blocking agents; stabilizers; stearates; ultraviolet light absorbers; viscosity regulators; waxes; and combinations of them.

Processing

The preparation of compounds of the present invention is uncomplicated. The compound of the present can be made in batch or continuous operations.

Mixing in a continuous process typically occurs in an extruder that is elevated to a temperature that is sufficient to melt the polymer matrix with addition either at the head of the extruder or downstream in the extruder of the solid ingredient additives. Extruder speeds can range from about 50 to about 500 revolutions per minute (rpm), and preferably from about 100 to about 300 rpm. Typically, the output from the extruder is pelletized for later extrusion or molding into polymeric articles.

Mixing in a batch process typically occurs in a Banbury mixer that is also elevated to a temperature that is sufficient to melt the polymer matrix to permit addition of the solid ingredient additives. The mixing speeds range from 60 to 1000 rpm and temperature of mixing can be ambient. Also, the output from the mixer is chopped into smaller sizes for later extrusion or molding into polymeric inkjet containers or parts of them.

Subsequent extrusion or molding techniques to make inkjet containers or parts of them are well known to those skilled in the art of thermoplastics polymer engineering. Without undue experimentation but with such references as "Extrusion, The Definitive Processing Guide and Handbook"; "Handbook of Molded Part Shrinkage and Warpage"; "Specialized Molding Techniques"; "Rotational Molding Technology"; and "Handbook of Mold, Tool and Die Repair Welding", all published by Plastics Design Library (www.williamandrew.com), one can make articles of any conceivable shape and appearance using compounds of the present invention.

Usefulness of the Invention

Inkjet ink containers are ubiquitous in personal and business locations. From a desktop inkjet printer in a home or office to a large format inkjet printer in a commercial printing establishment, the freshness of the inkjet ink can be protected by the use of polymer compounds described above using any of the four types of oxygen scavenging compositions.

The invention is not limited to the above embodiments. The claims follow.

What is claimed is:

1. An inkjet ink container comprising a polymer compound comprising an oxygen scavenging composition, wherein the oxygen scavenging composition is selected from the group consisting of:

(a) copolymers of polycondensate segments and oxygen scavenging moiety segments;

(b) oxygen scavenging unsaturated polymers;

(c) oxygen scavenging dendrimers;

(d) molecular hydrogen generators; and (e) combinations thereof.

2. The container of claim 1, wherein the polymer compound comprises a thermoplastic resin selected from the group consisting of polyesters, polyamides, polyolefins, polycarbonates, polystyrenes, polyacrylates, thermoplastic elastomers of all types, and combinations thereof.

3. The container of claim 2, wherein the polyester comprises polyethylene terephthalate, polybutylene terephthalate, polylactides or polyhydroxyalkanoates.

4. The container of claim 1, wherein the inkjet container is a print cartridge body.

5. The container of claim 1, wherein the inkjet container is an ink supply container for connection with a print cartridge body.

6. The container of claim 1, wherein the container is an ink supply container of any size or shape in which inkjet ink is stored before association with an inkjet printer.

7. The container of claim 6, wherein the container is an ink supply container of ink in bulk.

8. The container of claim 1, wherein the oxygen scavenging composition scavenges for (a) oxygen molecules within the volume of the container not occupied by the ink, (b) oxygen molecules within walls of the container, and (c) oxygen molecules permeating through the container walls.

* * * * *